United States Patent [19]

Cory

[11] Patent Number: 4,674,431

[45] Date of Patent: Jun. 23, 1987

[54] TRAFFIC CONTROL ELEMENT

[75] Inventor: Milton T. Cory, Gastonia, N.C.

[73] Assignee: Radiator Specialty Company, Charlotte, N.C.

[21] Appl. No.: 827,203

[22] Filed: Feb. 3, 1986

Related U.S. Application Data

[63] Continuation of Ser. No. 680,972, Dec. 12, 1984, abandoned.

[51] Int. Cl.[4] ..... G08B 23/00; E01F 9/00; E04H 17/00

[52] U.S. Cl. ..... 116/63 P; 340/114 R; 116/202

[58] Field of Search ..... 340/114 R; 116/63 P, 116/63 R; 40/612; D34/1

[56] References Cited

U.S. PATENT DOCUMENTS

| | | | |
|---|---|---|---|
| D. 215,345 | 9/1969 | Mangold | D34/1 |
| 3,618,556 | 11/1971 | Dittrich | 40/612 |
| 3,952,690 | 4/1976 | Rizzo | 116/63 P |
| 4,083,033 | 4/1978 | Kulp | 116/63 P |
| 4,475,101 | 10/1984 | Kulp | 40/612 |

FOREIGN PATENT DOCUMENTS

| | | | |
|---|---|---|---|
| 1926703 | 11/1970 | Fed. Rep. of Germany | 116/63 C |
| 1089822 | 11/1967 | United Kingdom | 116/63 P |

*Primary Examiner*—Charles Frankfort
*Assistant Examiner*—Denis E. Corr
*Attorney, Agent, or Firm*—Mason, Fenwick & Lawrence

[57] ABSTRACT

A traffic control drum is disclosed as an upright member having upper and lower ends, a support base adapted to rest on a support surface and an operator releasable mechanism for attaching the lower end of the member to the support base, so that the member is oriented in an upright relation to the support surface. The support base has an element exposed to be stepped on by the operator to hold the support base still on the support surface. The member has a mechanism disposed to be manually grasped by the operator, whereby the operator may urge the member away from the support base, while the operator holds the support base still with respect to the support surface to thereby effect release of the upright member from the support base.

16 Claims, 6 Drawing Figures

Fig-1
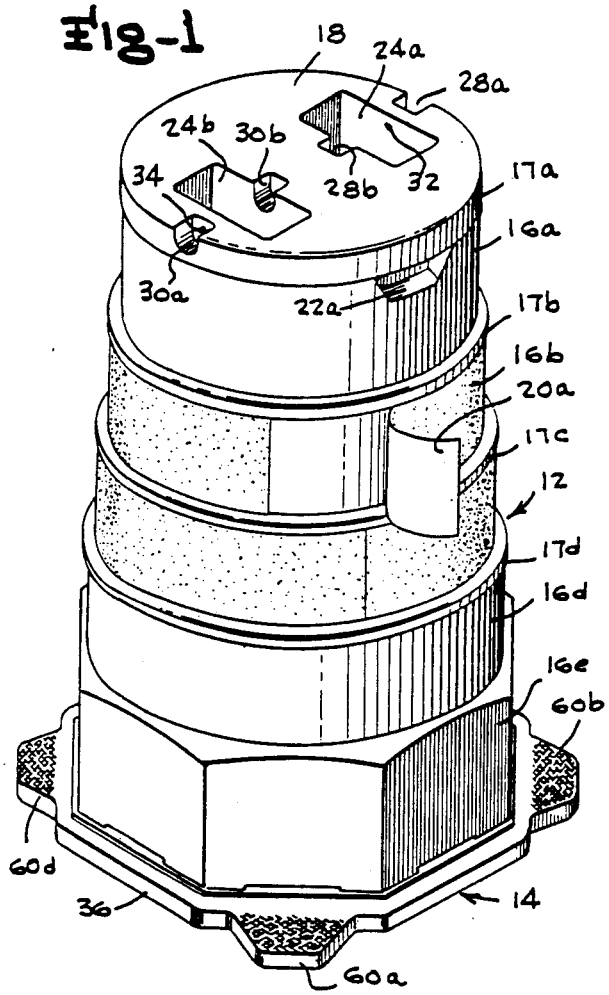
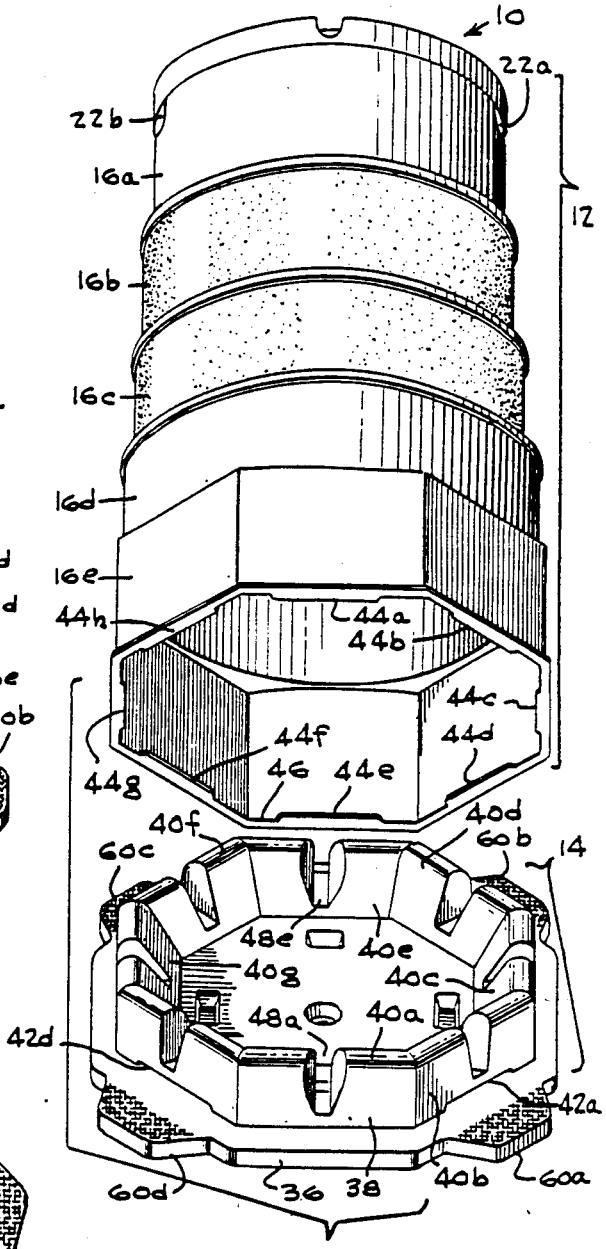
Fig-2
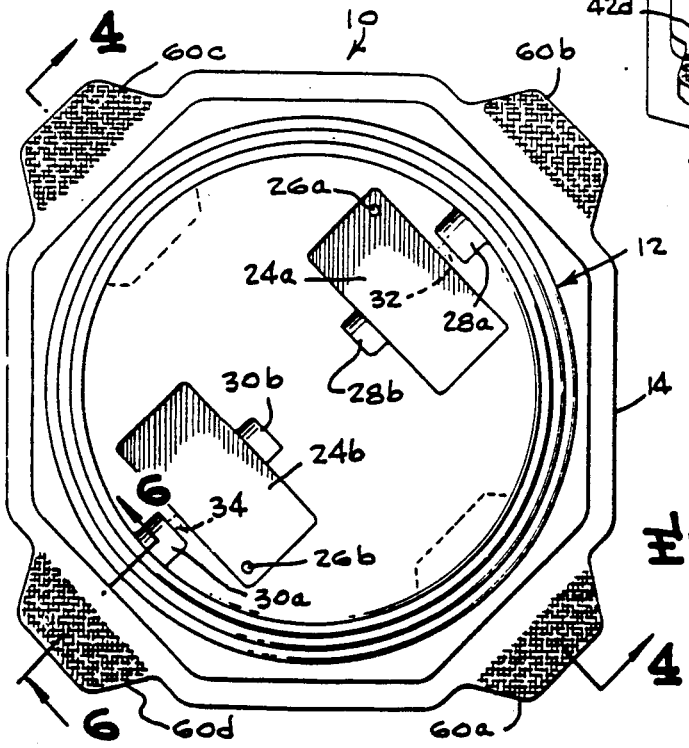
Fig-3

TRAFFIC CONTROL ELEMENT

This application is a continuation, of application Ser. No. 680,972, filed 12/12/84 now abandoned.

BACKGROUND OF THE INVENTION

1. Description of the Prior Art

This invention relates to traffic control elements and, more particularly, to those elements in the form of a drum having a support base and an upright member releasably connected to the support base.

2. Description of the Prior Art

Traffic control elements are used in the prior art to warn a vehicle operator of a road hazard or, otherwise, to guide the vehicle along a desired path. Typically, drums, set on one of their ends, have been used as such traffic control elements. These traffic drums are normally made of metal in the shape of an oil drum and of large capacity typically in the order of 30 to 55 gallons.

Such metal drums are typically quite heavy. The weight and bulk of such metal drums make them difficult for highway control personnel to move and position. To avoid such handling problems, plastic drums have been developed and are presently in wide use. However, such plastic drums provide less structural integrity and weight than metal drums. The weight reduction of such plastic drums makes them more desirable from the standpoint of handling, storage and transportation purposes. In addition, impact with plastic drums results in less motor vehicle damage or loss of control as compared to when a metal drum is impacted.

However, the light weight of a plastic drum requires that some means be provided to stabilize such drums from being toppled by high winds, minor vehicle impacts or the like so that drums will remain in their upright visible position. In the prior art, a weight or ballast typically in the form of a sand bag is disposed in the bottom of such plastic drums so that the drums will remain in an upright position or will return to their original position upon impact. Such prior art drums have also been designed to allow them to be readily stacked in a nested relationship for storage and transportation purposes. For nighttime use, plastic drums have been adapted to receive warning lights.

The plastic drum described in U.S. Pat. No. 4,083,033 of Kulp et al. is an example of such a plastic drum. In particular, the Kulp et al. drum comprises a hollow barrel-like control element, and a base interfitted with one end of the control element to mount its control element in a vertical position. Upon impact, the barrel-like control element is separated from its base, to minimize damage to the vehicle and to the traffic control drum itself.

In order to move or store an assembled two piece drum, it is necessary to disassemble the upright hollow element from its base, before removing the ballast. Otherwise, the assembled two piece drum and ballast is relatively heavy and difficult to move. The two piece drum as described in the Kulp et al. Patent '033 does not provide any means for permitting the quick and easy disassembly of its hollow upright element from its base. The Kulp et al. Patent '033 describes male, locking elements disposed about the periphery of the base, configured as a wedge and adapted to fit within openings cut or punched within the bottommost portion of the upright element. The two piece construction of Kulp et al. has proved difficult to disassemble in that traffic control personnel have a difficult time grasping the base and upright element to effect disassembly. Experience has shown that repeated assembly and disassembly of the Kulp et al. drum has tended to tear the unprotected openings in the upright element.

SUMMARY OF THE INVENTION

It is therefore an object of this invention to provide a new and improved traffic control drum of a two piece assembly, wherein the base and upright element are readily assembled and disassembled.

It is a more particular object of this invention to provide a new and improved traffic control drum of two piece construction, wherein there is provided improved means of increased durability for permitting repeated attaching and disconnecting of the two pieces.

In accordance with these and other objects of this invention, there is provided a traffic control drum comprising an upright member having upper and lower ends, a support base adapted to rest on a support surface and an operator releasable mechanism for attaching the lower end of the member to the support base, so that the member is oriented in an upright relation to the support surface. The support base has an element exposed to be stepped on by the operator to hold the support base still on the support surface. The member has a mechanism disposed to be manually grasped by the operator, whereby the operator may urge the member away from the support base, while the operator holds the support base still with respect to the support surface to thereby effect release of the upright member from the support base.

In an illustrative embodiment of this invention, the upright member is constructed to be essentially hollow having adjacent its lower end an inside wall formed in a given configuration. The support base has a member for defining an outside wall of a configuration matching that of the inside wall. The operator releasable mechanism comprises at least one detent affixed to and extending from the inside wall, and a slot formed in the outside wall for receiving the detent, whereby the upright member is releasably attached to the support base.

In a further aspect of this invention, the upright member and the support base is made of an elastic material so that when the operator grasps the manually graspable mechanism, steps on the exposed element and urges the upright member from the support base, the inside wall of the hollow member engages the outside wall of the support base, deforming the support base and enlarging the slot to facilitate release of the detent from the slot.

BRIEF DESCRIPTION OF THE DRAWINGS

While the specification concludes with claims particularly pointing out and distinctly claiming the subject matter of the invention, it is believed that the invention will be better understood from the following description taken in conjunction with the accompanying drawings, wherein:

FIG. 1 is a perspective view of a traffic control drum in accordance with the teachings of this invention;

FIG. 2 is a perspective view of the traffic control drum of FIG. 1, illustrating the two piece construction thereof and showing its support base and hollow member in a separated condition;

FIG. 3 is a top, plan view of the traffic control drum illustrated in FIGS. 1 and 2;

DESCRIPTION OF THE PREFERRED EMBODIMENT

Referring now to FIGS. 1 and 2, there is shown a traffic control drum 10 in accordance with the teachings of this invention. The traffic control drum 10 includes a support base 14 and a hollow member 12 normally disposed in an upright orientation as shown in FIG. 1 and designed to be releasably attached to its base 14. The releasable, hollow member 12 includes a plurality of sections 16*a*, 16*b*, 16*c*, 16*d* and 16*e*. The sections 16*a*, 16*b*, 16*c*, 16*d* and 16*e* are successively of greater dimension, section 16*a* being of the smallest dimension and section 16*e* being of the largest dimension. As illustrated in FIGS. 1 and 2, each of the sections 16*a*, 16*b*, 16*c*and 16*d* is of generally circular configuration, whereas section 16*e* is made of a plurality of sides or facets arranged next to each other to define a closed configuration such as an octagon having eight sides.

Figure 5:
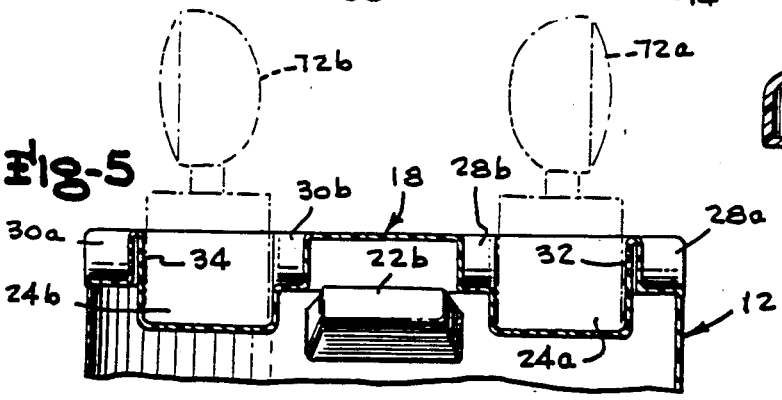
FIG. 5 is a partial, sectioned view of the traffic control drum taken through line 5—5 of FIG. 4.

The hollow member 12 is enclosed by a top portion 18 in which there is inset a pair of wells 24*a* and 24*b* for respectively receiving warning light 72*a* and 72*b* as shown in dotted line in FIG. 5. The warning lights 72*a* and 72*b* are releasably secured within the wells 24*a* and 24*b*, respectively, by bolts not shown. As particularly illustrated in FIGS. 1 and 3, well 24*a* is associated with recesses 28*a* and 28*b*. A bolt is inserted through a bolt receiving passage 32 so as to pass through a threaded opening within its warning light 72*a* before coming to rest in recess 28*b*, whereby the warning light 72*a* is retained in its well 24*a*. Similarly, the well 24*b* is associated with recesses 30*a* and 30*b* for receiving a bolt through its threaded, bolt receiving passage 34.

As required by various state and federal regulations, reflective strips 20*a* and 20*b* are, illustratively, disposed about sections 16*b* and 16*c*, to make the traffic control drum 10 more visible at night. It is understood that the reflective strips 20*a* and 20*b* may be made of selected colored materials to meet various regulations. Each of the sections 16*a*, 16*b*, 16*c* and 16*d* has a corresponding bumper 17 disposed at its topmost part and raised to protect the strips 20 from damage and/or removal when the hollow member 12 has been released by vehicle impact.

Figure 4:
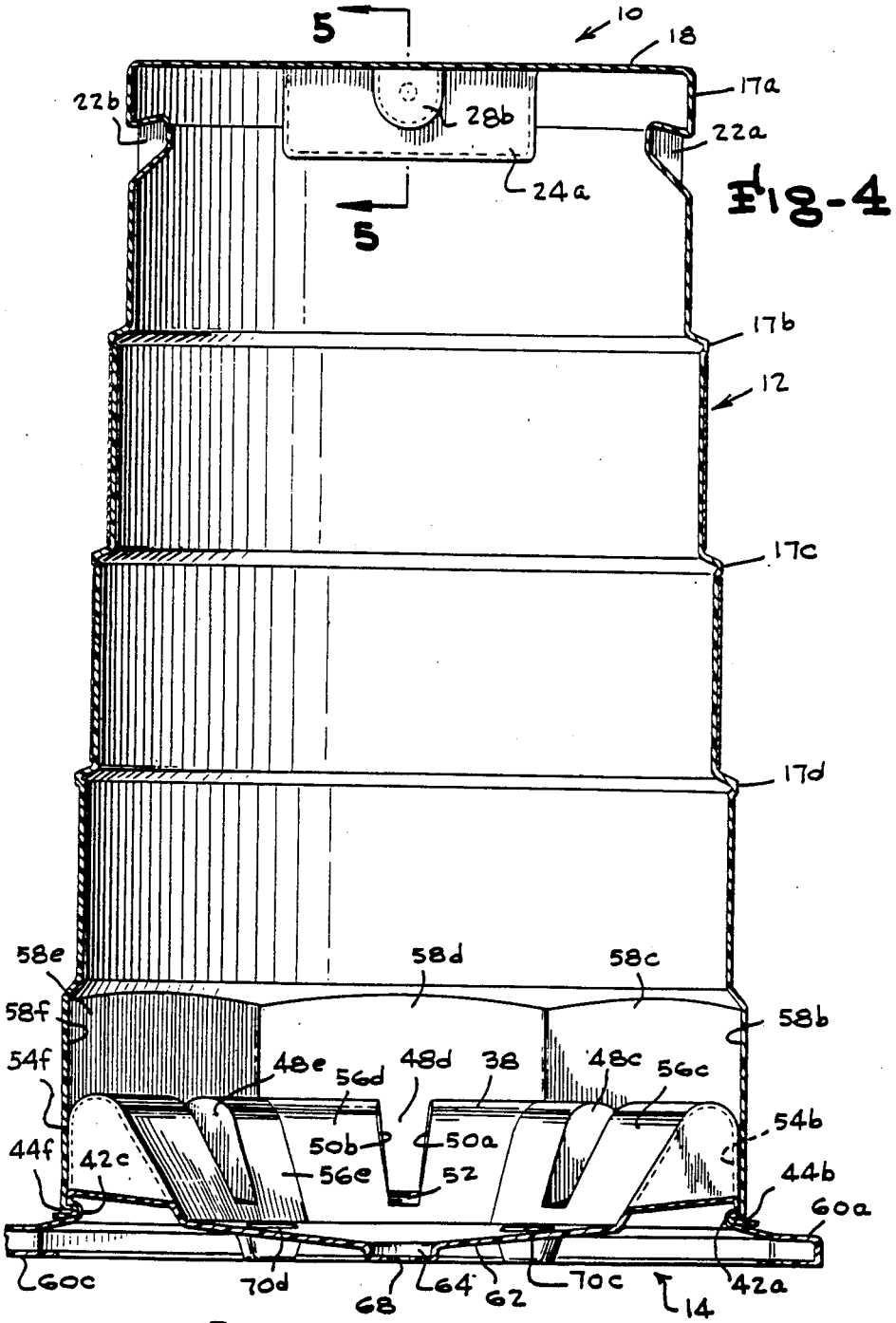
FIG. 4 is a side, sectioned view of the traffic control drum taken through line 4—4 of FIG. 3.

The support base 14 is more fully shown in FIGS. 2 and 4. The support base 14 comprises a platform 36, which rests on a support surface, typically a road or road edge. The platform is shaped illustratively as an octagon, similar to the configuration of section 16*e*. A plurality, illustratively four, of footpads 60*a*, 60*b*, 60*c* and 60*d* extends from respective sides of the platform 36 to facilitate, as will be explained in detail below, the release of the hollow member 12 from the support base 14. In addition, a pair of inset handles 22*a* and 22*b* is provided in the section 16*a* to facilitate the release of the hollow member 12 from the support base 14. As illustrated in FIG. 2, the topmost surface of each of the footpads 60*a*, 60*b*, 60*c* and 60*d* is provided with a roughened surface or grid to effect a sure grip when a traffic controller places his/her foot thereon to release the hollow member 12 from the support base 14.

Further, the support base 14 includes an annularly shaped, releasing locking member 38 disposed and extending upwardly, as shown in FIG. 2, from the platform 36. The releasing locking member 38 is illustratively shaped as an octagon, in a manner similar to the configuration of section 16*e*. More specifically, the releasing locking member 38 has eight sides 40*a*, 40*b*, 40*c*, 40*d*, 40*e*, 40*f*, 40*g* and 40*h*. Each of the sides 40*b*, 40*d*, 40*f* and 40*h* has a corresponding slot 42, there being a total of four slots 42*a*, 42*b*, 42*c* and 42*d*. Each slot 42 is disposed at the bottom point of its side 40, where that side 40 meets the platform 38.

Further, each side 40 of the releasing locking member 38 has a channel 48 disposed through the center thereof, there being eight channels 48*a*, 48*b*, 48*c*, 48*d*, 48*e*, 48*f*, 48*g* and 48*h*. The channels 48 serve to strengthen the releasing locking member 38 to better withstand vehicle impact. As particularly shown in FIG. 4, each channel 48 has side walls 50*a* and 50*b*, which are integrally formed with an outside wall 54 and an inside wall 56. A bottom wall 52 is disposed at the bottom of each channel 48 to form with the side walls 50*a* and 50*b* its channel 48.

A conically shaped bottom 62 extends from the inside walls 56 of the releasing locking member 38 and extends downwardly toward a water release opening 68, as best shown in FIG. 4. The opening 68 is disposed centrally of the platform 36 and aligned with the center axis of the releasable hollow member 12, when it is attached to its support base 14. The opening 68 is disposed at the bottom of a recess 64 and permits the release of water as may collect within the traffic control drum 10. Further, a plurality, illustratively four, of support feet 70*a*, 70*b*, 70*c* and 70*d* is disposed equally spaced about the bottom 62 and rest on the road or support surface to receive the weight or ballast (not shown) whereby the ballast is supported.

Figure 6:
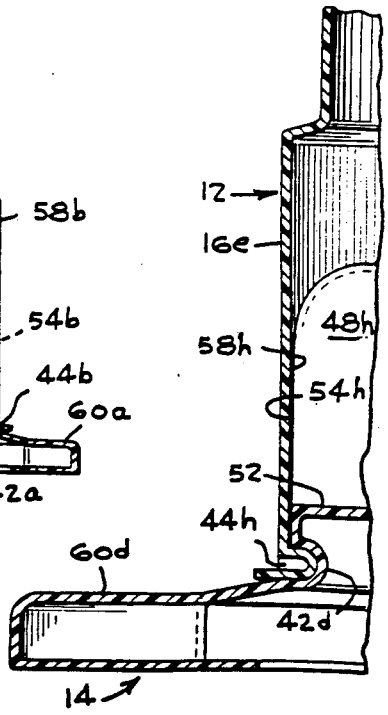
FIG. 6 is partial, sectioned view of the traffic control drum taken through line 6—6 of FIG. 3.

Referring now to FIGS. 2, 4 and 6, the means for releasing the releasable hollow member 12 from its support base 14 will be described in detail. As best shown in FIG. 2, the bottom portion of the releasable hollow member 12 is formed with an annularly shaped lip 46. A plurality, illustratively eight, of detents 44*a*, 44*b*, 44*c*, 44*d*, 44*e*, 44*f*, 44*g* and 44*h* is formed integrally with the lip 46 and extends radially inward toward the center axis of the releasable hollow member 12. Each detent 44 is aligned centrally of its side or facet 58 of the bottommost section 16*e*. As a result when the releasable hollow member 14 is placed upon its support base 14 and the outside walls 54 are aligned with the corresponding inside sides or facets 58 (58*d*, 58*e* and 58*f* are illustrated in FIG. 4), the corresponding detents 44 are then aligned with and are insertable within the slots 42. In a preferred embodiment of this invention, there are only four slots 42. Eight detents 44 are provided so that regardless of the alignment between the hollow member 12 and the base 14, alternate ones of the detents 44 can be inserted into the aligned slots 42 without further adjustment or rotation of the hollow member 12. After alignment, the releasable hollow member 12 is pushed downward by a traffic controller, as seen in FIG. 4, whereby the detents 44 are inserted and secured within the slots 42; see particularly the relationship of detent 44*h* to slot 42*h*, as shown in FIG. 6. At this point, the releasable hollow member 12 is releasably attached to its support base 14.

If the traffic control drum 10 is to be moved, it is normally desired to release the hollow member 12 from its support base 14, whereby the ballast may be removed before moving the support base 14 and hollow member 12. If desired, a number of the releasable hollow members 12 may be stacked one upon the other for storage and/or transportation. To facilitate release of the hollow member 12, the traffic controller stands on one or more of the footpads 60 and grasps one of the inset handles 22*a* and 22*b*. The inset handles 22 are disposed in the topmost section 16*a* at a height that facilitates ready grasping by the traffic controller. In one illustrative embodiment of the invention, the top portion 18 has a height of 37½ inches. Referring to FIG. 4, the traffic controller would for example grasp the handle 22*b*, while placing his/her foot on one of the pedals 60*d* or 60*c* and, thereafter, pull the releasable hollow member 12 upward with a counter clockwise motion, whereby the detent 44*g* is released from the slot 42*g*.

As particularly illustrated in FIG. 6, each of the slots 42 is of a U-shaped configuration and is recessed into the side of the support base 14. Further, the slots 42 are integral with the remaining portions of the support base 14. In one illustrative embodiment of this invention, each of the releasable hollow member 12 and its support base 14 is manufactured by molding of a suitable resilient, impact resistant material such as polyethylene. As the releasable hollow member 12 is raised upward and rotated counter clockwise as seen in FIG. 4, its inside facet 58*h* is directed against the outside wall 54*f* disposing it to the right, whereby the slot 42*c* as formed of a flexible material tends to open, thus permitting the detent 44*f* to be pulled therefrom. It is understood that while the releasable hollow member 12 is being pulled upward and in a counter clockwise direction, the support base 14 is being held securely to the ground by the foot of the traffic controller. In this manner, the releasable hollow member 12 may be readily attached and released from its support base 14.

In addition, the integrally formed slots 42 are not subject to relative tearing as has occurred with recesses or openings of the prior art that are cut through their support bases. Field experience has indicated that the described structure and relationship of the detents 44 and slots 42 of this invention to provide an easy, durable means for releasably securing the hollow member 12 to its support base 14.

In considering this invention, it should be remembered that the present disclosure is illustrative only and the scope of the invention should be determined by the appended claims.

I claim as my invention:

1. A traffic control drum comprising:

an elongated hollow member having upper and lower ends, said upper end being enclosed by a top-portion and said lower end being open;

the interior of said lower end including a plurality of contiguous interior flat faces arranged parallel to the longitudinal axis of said member and next to each other about the periphery of said lower end in a first closed configuration to define an inside wall;

a support base adapted to rest on a support surface, said support base including a plurality of exterior flat faces arranged parallel to the center axis of said base and next to each other about the periphery of said support base in a second given configuration to define an outside wall;

said first and second given configurations matching each other so that each of said exterior faces mate with a corresponding interior face when said interior of said lower end covers and is supported by said outside wall of said support base;

a plurality of slots, each of said slots defined in a different one of said plurality of exterior flat faces, said slots extending from said face inwardly toward the center axis of the support base;

a plurality of detents, each of said detents defined in a different one of said plurality of interior flat faces, said slots extending inwardly toward the longitudinal axis of said hollow member.

each of said detents adapted to be disposed in a different one of said slots to thereby releasably attach said hollow member to said support base; and a plurality of planar rigid foot pads, each of said foot pads extending outwardly from said support base so as to be free of said releasable attaching arrangement.

2. The traffic control drum as claimed in claim 1, wherein each of said foot pads emanates from a different one of said flat faces.

3. The traffic control drum as claimed in claim 2, wherein the number of interior flat faces constituting said plurality is eight and the number of exterior flat faces constituting said plurality is eight.

4. The traffic control drum as claimed in claim 3, wherein the number of slots constituting said plurality is at least four.

5. The traffic control drum as claimed in claim 2, wherein at least two of said foot pads are arranged to emanate from opposed flat faces which each possess one of said slots.

6. The traffic control drum as claimed in claim 1, wherein said releasable attaching arrangement further comprises a plurality of handles affixed to said hollow member.

7. The traffic control drum as claimed in claim 6, wherein said elongated hollow member comprises at least one side disposed in a vertical relationship with respect to said support surface, when said member is attached to said support base.

8. The traffic control drum as claimed in claim 7, wherein said handles are formed as recesses within said vertically extending side.

9. The traffic control drum as claimed in claim 1, wherein each slot comprises means for forming a recess about said slot for receiving said detent through said slot, said recess being of a given initial configuration.

10. The traffic control drum as claimed in claim 9, wherein each of said plurality of detents is made of an elastic material and of a configuration to that of said recesses, whereby the engagement and release of said detents with respect to said recesses is facilitated.

11. The traffic control drum as claimed in claim 6, wherein each of said hollow member and said support base is made of an elastic material so that when the operator grasps said handles, steps on a foot pad and urges said hollow member from said support base, said inside wall of said hollow member engages said outside wall of said support base, deforming said support base and altering the shape of said slot to facilitate release of said detent from said slot.

12. The traffic control drum as claimed in claim 11, wherein said support base comprises a releasing member extending upright with respect to the support surface for defining said inside wall, said releasing member being of substantially annular configuration for receiving therein a ballast to hold said support base at rest.

13. The traffic control drum as claimed in claim 12, wherein said releasing member has a plurality of channels disposed through said releasing member and equally spaced thereabout to form ribs therebetween.

14. The traffic control drum as claimed in claim 13, said support base comprises a bottom having an opening therein to effect release of water from said traffic control drum.

15. The traffic control drum as claimed in claim 1, wherein said hollow member has a plurality of sections, one section disposed above the other along an axis of said hollow member, selected of said sections having thereon a reflective material to make said traffic control drum more visible and a bumper disposed along an edge thereof and raised above said reflective material thereby protecting said reflective from damage.

16. A traffic control drum comprising:

an elongated hollow member having upper and lower ends, said upper end being enclosed by a top-portion and said lower end being open;

the interior of said lower end including a plurality of contiguous interior flat faces arranged parallel to the longitudinal axis of said member and next to each other about the periphery of said lower end in a first closed configuration to define an inside wall;

a support base adapted to rest on a support surface, said support base including a plurality of exterior flat faces arranged parallel to the center axis of said base and next to each other about the periphery of said support base in a second given configuration to define an outside wall;

said first and second given configurations matching each other so that each of said exterior faces mate with a corresponding interior face when said interior of said lower end covers and is supported by said outside wall of said support base;

a plurality of recessed slots, each of said slots defined in one of either said plurality of exterior flat faces or said plurality of interior flat faces;

a plurality of projecting detents, each of said detents defined in the other of said plurality of interior flat faces and said plurality of interior flat faces;

each of said detents adapted to be disposed in a different one of said slots to thereby releasably attach said hollow member to said support base; and a plurality of planar rigid foot pads, each of said foot pads extending outwardly from said support base so as to be free of said releasable attaching arrangement.

* * * * *